US007651360B2

(12) United States Patent
Cheng

(10) Patent No.: US 7,651,360 B2
(45) Date of Patent: Jan. 26, 2010

(54) ELECTRICAL CARD CONNECTOR HAVING A HOLDING DEVICE

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,636

(22) Filed: Sep. 30, 2008

(65) Prior Publication Data

US 2009/0111309 A1 Apr. 30, 2009

(30) Foreign Application Priority Data

Oct. 26, 2007 (TW) ..... 96218025 U

(51) Int. Cl.
*H01R 13/62* (2006.01)

(52) U.S. Cl. ..... 439/345

(58) Field of Classification Search ..... 439/607, 439/345

See application file for complete search history.

(56) References Cited

U.S. PATENT DOCUMENTS 5,492,481 A * 2/1996 Lewis ..... 439/159
6,162,075 A * 12/2000 Hara et al. ..... 439/159
7,061,770 B2 * 6/2006 Mayer et al. ..... 439/377
7,086,906 B1 8/2006 Ding
7,094,097 B2 * 8/2006 Cheng et al. ..... 439/607

FOREIGN PATENT DOCUMENTS

TW 094217451 3/2006

* cited by examiner

*Primary Examiner*—Briggitte R Hammond
(74) *Attorney, Agent, or Firm*—Andrew C. Cheng; Wei Te Chung; Ming Chieh Chang

(57) ABSTRACT

An electrical card connector assembled on a bracket, comprising: an insulative housing; a plurality of contacts received by the insulative housing; a shell covering on the insulative housing; and a holding device located at the outside of the electrical card connector and comprising a retaining hole and a screw hole beside the retaining hole, and the bracket comprising a post mating with the retaining hole of the holding device to prevent the electrical card connector from revolving.

8 Claims, 4 Drawing Sheets

ELECTRICAL CARD CONNECTOR HAVING A HOLDING DEVICE

BACKGROUND OF THE INVENTION

1. Field of the Invention

The present invention generally relates to an electrical card connector, and more particularly to an electrical card connector having a holding device.

2. Description of Prior Art

An electrical card connector is required to receive an electrical card to achieve the storage or transmission of signal between the electrical card and the corresponding electronic appliance. In order to satisfy requirements of assembly and space, the electrical card connector, receiving an express card having quicker speed than a conventional card at data transmission, is usually assembled on a bracket, such as a bracket of hard disk drive (HDD).

Taiwan Patent NO. M288980 discloses an express card connector which is assembled on a bracket. The express card connector comprises an insulative housing, a plurality of contacts received in the insulative housing and a shell covering the insulative housing. The shell is formed with holding devices defining screw holes. A plurality of copper columns are rivet on the bracket to mate with the screw holes of the shell in virtue of screws to assemble the electrical card connector on the bracket. The electrical card connector will revolve around the copper column when one screw mates with the screw hole of the copper column, and the other screw holes of the holding device and the screw holes of the copper column do not link up mutually. It is necessary to relocate the electrical card connector before fixing the other screws.

Hence, it is desirable to have an improved card connector to overcome the above-mentioned disadvantages of the prior art.

BRIEF SUMMARY OF THE INVENTION

Accordingly, the object of the present invention is to provide an electrical card connector having a holding device for locating the electrical card connector on a bracket.

In order to achieve the above-mentioned object, an electrical card connector assembled on a bracket, comprising: an insulative housing; a plurality of contacts received in the insulative housing; a shell covering on the insulative housing; and at least a holding device located at the outside of the electrical card connector and comprising a retaining hole and a screw hole beside the retaining hole, and the bracket comprising at least a post mating with the retaining hole of the holding device.

Other objects, advantages and novel features of the invention will become more apparent from the following detailed description of the present embodiment when taken in conjunction with the accompanying drawings.

DETAILED DESCRIPTION OF THE INVENTION

Figure 1:
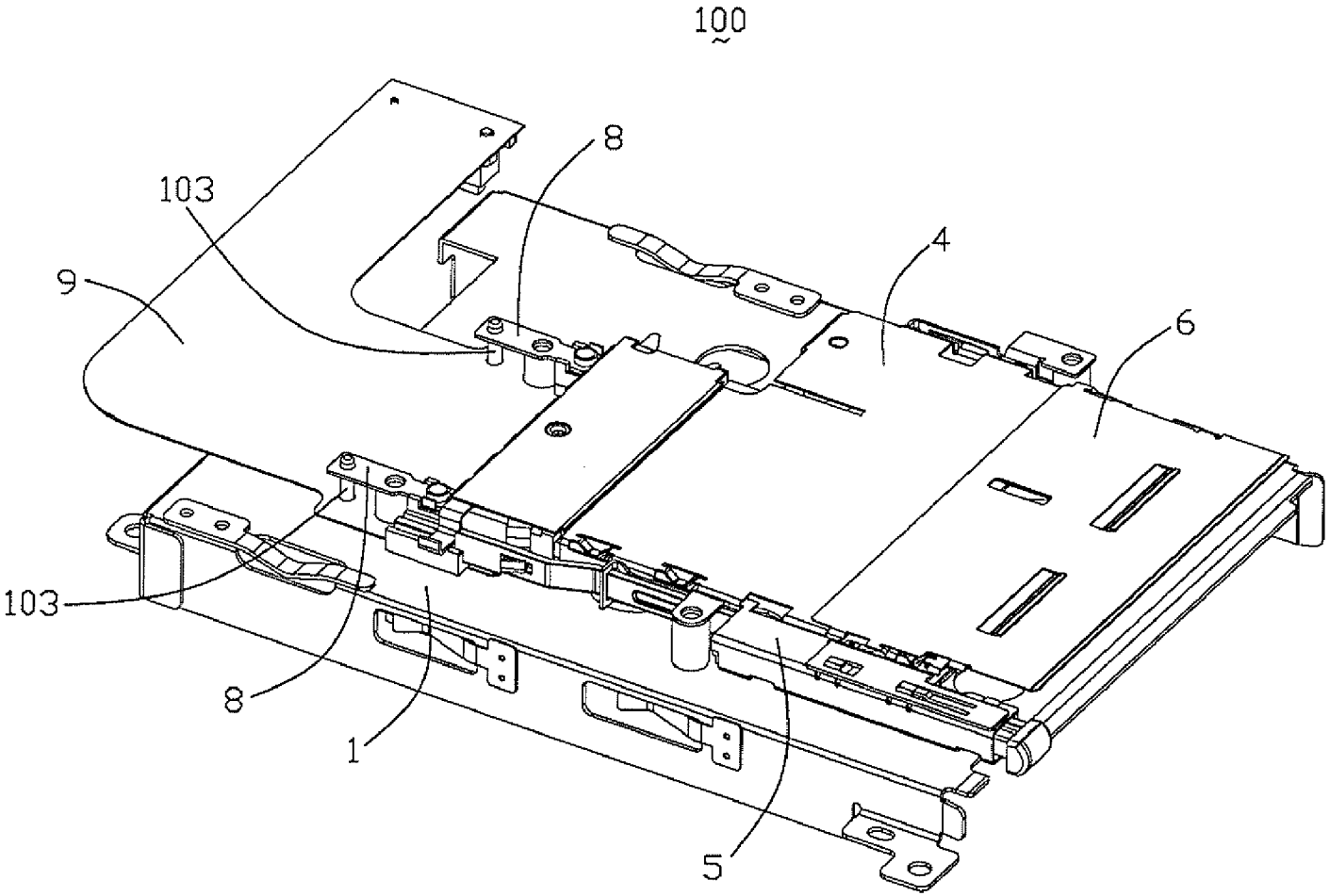
FIG. 1 is a perspective view of an electrical card connector and a bracket in accordance with the present invention.

Reference will now be made to the drawing figures to describe the present invention in detail.

Referring to FIGS. 1-4, an electrical card connector 100 in accordance with the present invention is assembled on a bracket 1. In this embodiment, the bracket 1 is used to hold a hard disk drive (HDD) (not shown), and the bracket 1 also could be a printed circuit board (PCB). The electrical card connector 100 is approximately L-shaped and can receive a rectangular card or an L-shaped card (not shown), comprising an insulative housing 2, a plurality of contacts (not labeled) received in the insulative housing 2, a shell 4 covering the insulative housing 2, an ejector 5 disposed on the shell 4, a covering plate 6 located at a rear end of the shell 4, a guiding member 7 received by the shell 4, a pair of holding device 8.

Figure 2:
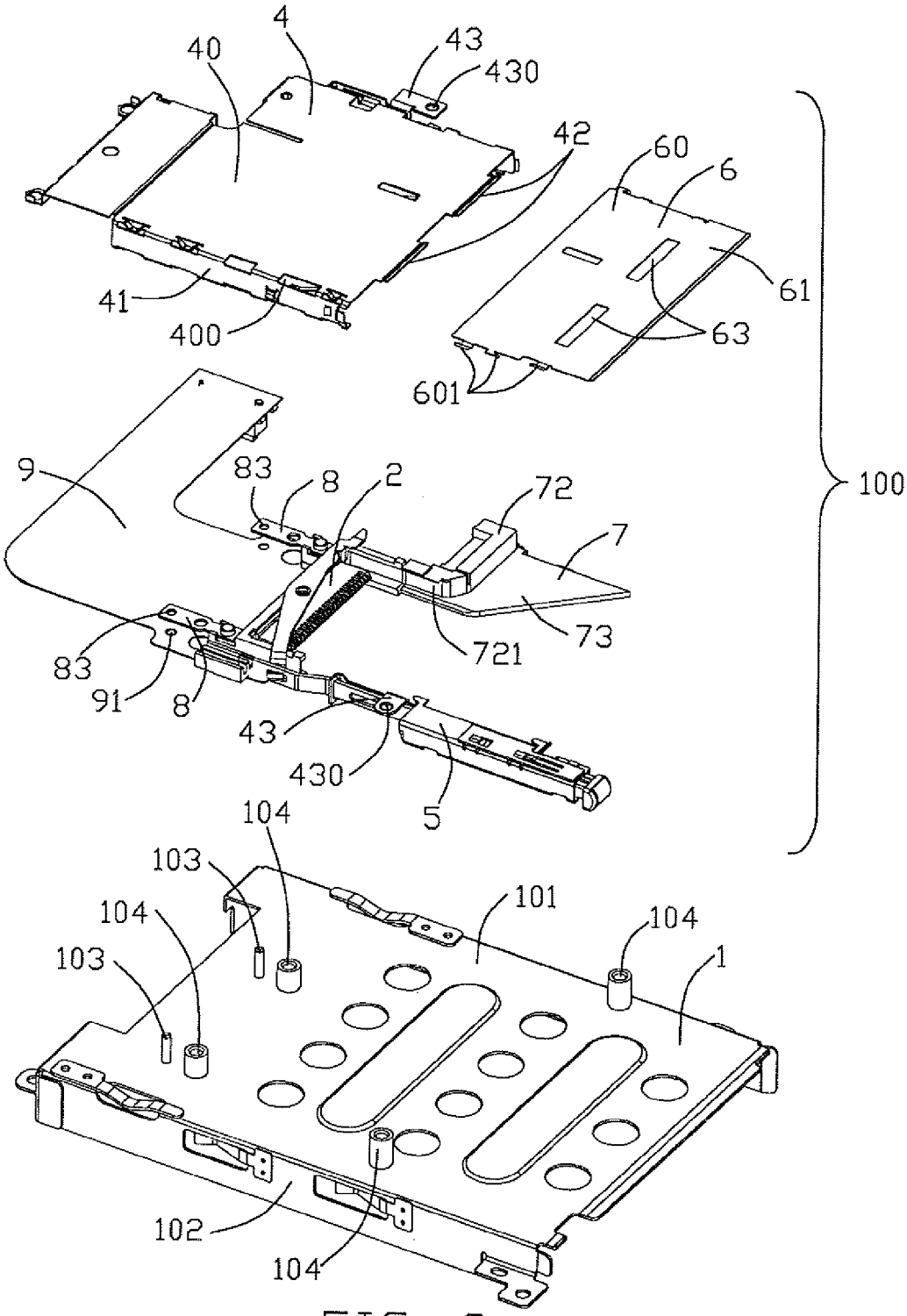
FIG. 2 is an exploded, perspective view of the electrical card connector and the bracket shown in FIG. 1.
Figure 3:
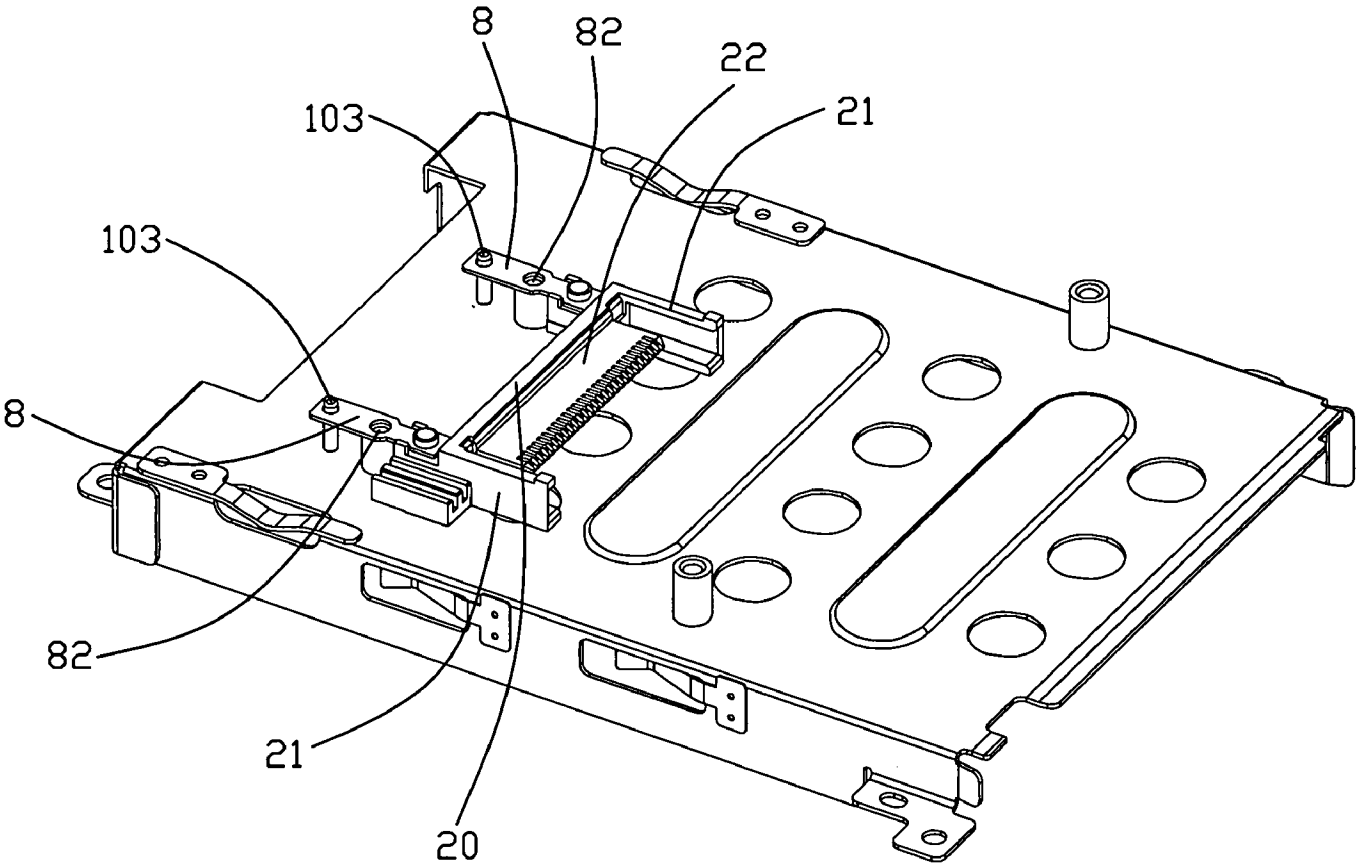
FIG. 3 is a perspective view of an insulative housing with a holding device mating with the bracket.
Figure 4:
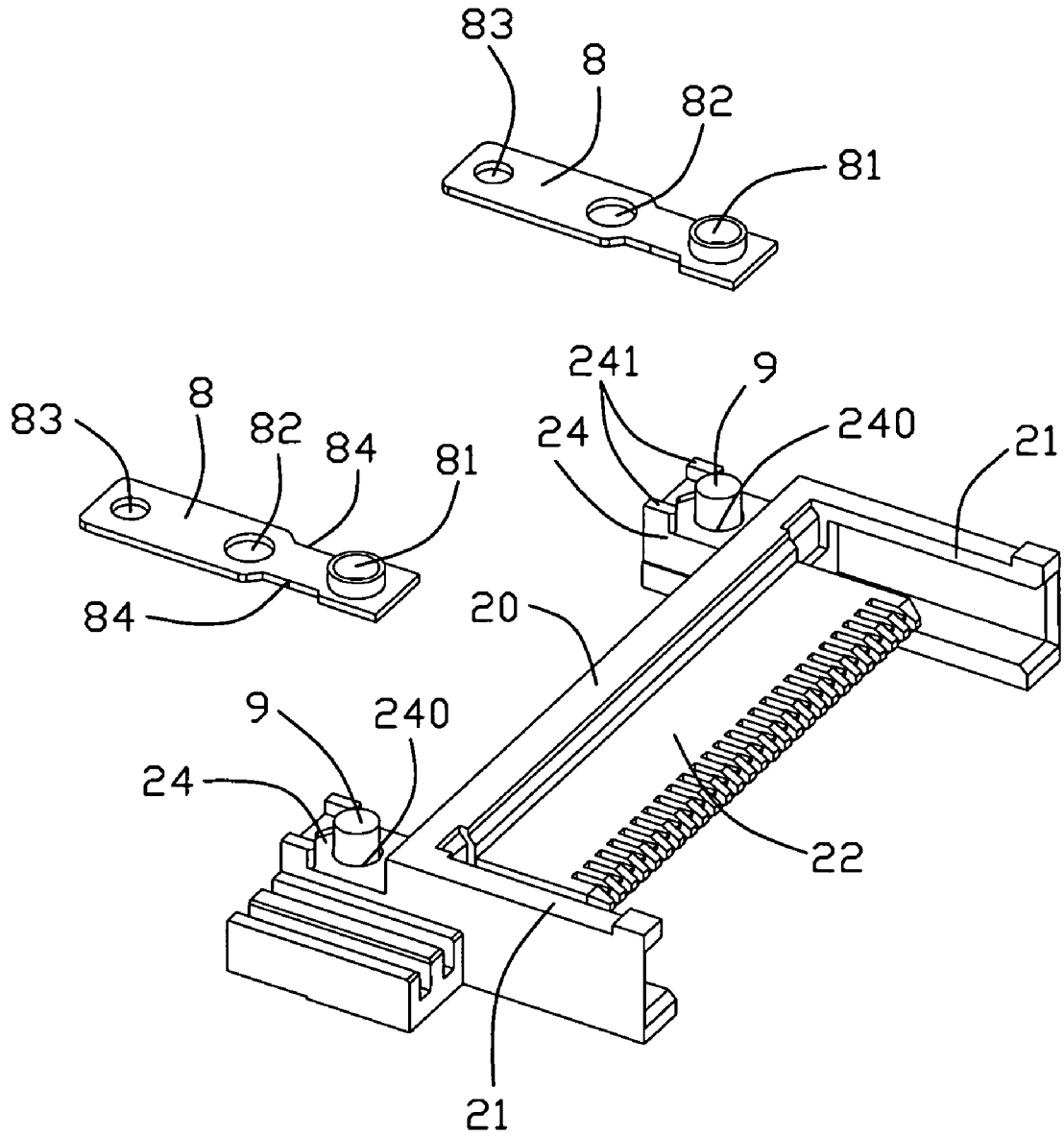
FIG. 4 is an exploded, perspective view of the insulative housing and the holding device shown in FIG. 3.

Referring to FIGS. 2-4, The elongated insulative housing 2 has a base 20, a pair of guiding arms 21 and a pair of assembling portion 24 extending forwardly from opposite sides of the base 20 respectively. A mating portion 22 extends from the base 20 and is disposed between the two guiding arms 21. Each assembling portion 24 defines a column hole 240 and a pair of tubers 241 in the front of the column hole 240. The contacts (not labeled) are received in the mating portion 22 for mating with the inserted electrical card (not shown) electrically.

Referring to FIG. 1 and FIG. 2, the shell 4 forms an approximately L-shape configuration with a rear end wider than a front end. The shell 4 comprises a top wall 40, and a pair of lateral walls 41 with different lengths extending downwardly from the top wall 40. A card inserting opening (not labeled) is defined at the rear end of the shell 4 between the lateral walls 41. Each lateral wall 41, connecting with the top wall 40, comprises a pair of slots 400 for locking with the covering plate 6. Furthermore, two locking portions 42 extend from the rear edge of the top wall 40 to mate with the covering plate 6. A fixing portion 43 with a fixing hole 430 is assembled on each lateral walls 41.

The covering plate 6, assuming a rectangular configuration, comprises a front portion 60 overlapping the rear end of the shell 4 and a rear portion 61 extending from the front portion 60. Each side of the front portion 60 forms a plurality of hooks 601 cooperating with the card inserting opening(not labeled) and the slots 400, so that the covering plate 6 is fastened onto the shell 4. The jointing portion of the front portion 60 and the rear portion 61 forms a pair of grooves 63 engaging with the locking portion 42 so as to further join the covering plate 6 to the shell 4.

Referring to FIG. 2, the guiding member 7 is approximately a triangle shape and assembled to the shell 4. The guiding member 7 has a board portion 73 and an L-shaped perpendicular wall 72 extending forwardly and upwardly from a front end of the board portion 73. The perpendicular wall 72 forms a guide channel 721 extending in a front-to-rear direction for guiding the electrical card(not shown) inserting into or ejecting out of the electrical card connector 100.

Referring to FIGS. 1-4, the pair of the holding devices 8 are assembled on the assembling portion 24 of the insulative housing 2, and each assumes metal plate and comprises a through hole 81, a retaining hole 83 and a screw hole 82. The through hole 81 and the column hole 240 link up mutually, and a pair of fixing members 9 are received in the through hole 81 and the column hole 240 to assemble the holding device 8 on the insulative housing 2. The screw holes 82 is disposed between the through hole 81 and the retaining hole 83 and the three holes arrange in line. The holding device 8 further comprises a pair of gaps 84 on the lateral side thereof, and the pair of the tubers 240 clamps the holding device 8 in the gaps 84.

Referring to FIGS. 1-3, the bracket 1 comprises a main plate 101 and a pair of side portions 102 extending downwardly from opposite laterals of the main plate 101. The electrical card connector 100 is assembled on an outside of the main plate 101. A plurality of columns 104 are rivet on a front and rear ends of the main plate 101, respectively. The columns 104 are located under the through hole 81 and the fixing hole 240, and a plurality of screws (not shown) mates with the columns 104 to hold the electrical card connector 100 on the bracket 1. The main plate 101 further comprises a plurality of posts 103 closing to the column 104 on the front ends thereof, and the post 103 engages with the retaining hole 83 of the holding device 8. A FPC 9 is connected to the housing 2 and defines a mounting hole 91, and the post 103 passes through the mounting hole 91.

When the electrical card connector 100 is assembled on the bracket 1, the posts 103 is inserted into the retaining holes 83, so that the electrical card connector 100 is located on the bracket 1, and the through holes 81 and the fixing holes 240 correspond with the columns 104 by itself, and the pair of posts prevent the electrical card connector 100 from revolving when the first screw(not shown) mates with one of the columns 104.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector assembly comprising:

a bracket having at least two columns and posts extending from a top face thereof;

a card connector positioned on a the top face of said bracket, and having a housing with a plurality of contacts retained thereon and a shell coveting the housing, the shell having one end fastened to one of the at least two columns;

a metallic holding device having one end fastened to the post located on the bracket and the other end fastened to the housing.

2. The card connector assembly as claimed in claim 1, wherein an FPC is connected to the connector and defines a mounting hole through which said post extends.

3. The card connector assembly as claimed in claim 1, wherein the metallic holding device comprises a retaining hole for mating with the post of the bracket and a screw hole for mating with the column of the bracket.

4. The card connector assembly as claimed in claim 3, wherein the housing comprises a base and a pair of assembling portions extending from opposite sides of the base, and the holding device comprises a through hole for holding the holding device on the assembling portion.

5. The card connector assembly as claimed in claim 4, wherein the assembling portion forms a pair of tubers thereon for clamping the holding device.

6. The card connector assembly as claimed in claim 5, wherein the retaining hole, the screw hole and the through hole are arranged in a line.

7. An electrical card connector assembly comprising:

a bracket having at least a pair of posts extending from a top face thereof and spaced from each other in a transverse direction;

a card connector positioned on the top face of said bracket; and a pair of metallic holding devices each having one end fastened to the corresponding post located on the bracket and the other end fastened to the housing; wherein an FPC is connected to the connector and defines a pair of through holes which the pair of posts extend through, respectively.

8. The electrical card connector assembly as claimed in claim 7, wherein said bracket is further equipped with a pair of columns extending through a pair of corresponding through apertures and supportably engaging undersurfaces of the corresponding holding devices, respectively.

* * * * *